United States Patent [19]

Mulay

[11] Patent Number: 4,458,661

[45] Date of Patent: Jul. 10, 1984

[54] ACCESSORY FOR STOVE AND METHOD OF MAKING SAME

[75] Inventor: Salvatore S. Mulay, Canoga Park, Calif.

[73] Assignee: Jacobson Products, Co., San Fernando, Calif.

[21] Appl. No.: 449,189

[22] Filed: Dec. 13, 1982

[51] Int. Cl.[3] ..... F24C 3/00

[52] U.S. Cl. ..... 126/39 M; 219/461; 220/458

[58] Field of Search ..... 126/39 M; 219/458, 460, 219/461; 220/458, 405; 428/421, 461

[56] References Cited

U.S. PATENT DOCUMENTS

| | | | |
|---|---|---|---|
| 2,856,503 | 10/1958 | More | 219/460 |
| 3,165,201 | 1/1965 | Woodman | 126/39 M X |
| 3,495,735 | 2/1970 | Ulam et al. | 220/458 X |
| 4,009,795 | 3/1977 | Hurko et al. | 219/461 X |
| 4,250,215 | 2/1981 | Mayer | 220/458 X |

*Primary Examiner*—Samuel Scott
*Assistant Examiner*—Margaret A. Focarino
*Attorney, Agent or Firm*—G. Donald Weber, Jr.

[57] ABSTRACT

An improved accessory or drip pan, and method of making same, is shown and described which is used under heating units of a stove for collecting spilled liquids and foods from pots and pans during cooking.

23 Claims, 6 Drawing Figures

ACCESSORY FOR STOVE AND METHOD OF MAKING SAME

BACKGROUND

1. Field of the Invention

This invention is directed to an improved accessory for using with a stove. Such stove may be electric or gas or other means of supplying heat and used either in the home or a commercial establishment such as a restaurant or food production operation.

2. Description of the Prior Art

Accessories for use with stoves, such as drip pans, are known in the art. Many drip pans which are presently in use, have an upper surface, usually metallic, which comes into direct contact with liquids and foods spilled or boiled over from pots and pans. Frequently, if such drip pans are not immediately cleaned and such spilled substances immediately removed, the liquids and foods become charred or baked on to the metallic surface. As a consequence, removal of such substances and cleaning of the drip pan becomes very difficult. Because of such cleaning difficulty, many drip pans are not cleaned but periodically disposed of. Some have sought to alleviate this health hazard by covering such accessories with a sheet of disposable aluminum foil. Such a procedure is generally not completely satisfactory because it is difficult to keep the aluminum foil in close contact with the entire upper surface of the drip pan. In such cases, spilled substances frequently run through the drip pan and are not collected, thereby essentially defeating the purpose and intent of the drip pan. Thus, there is a need for an accessory to a stove, i.e. a drip pan which has an upper surface which is adherence resistant to liquids and foods and charred derivatives thereof, and which is operative to withstand temperatures present in drip pan environments, and which will also not deteriorate and will have a relatively long useful life while simultaneously being relatively inexpensive to produce. This invention is directed to such a stove accessory.

SUMMARY OF THE INVENTION

This invention is directed to an improved stove accessory, namely a drip pan, and a method of making same. The method includes forming the composite material from which the drip pan is made and the method of making therefrom.

The drip pan apparatus, and the method of making same, described herein produces a product which has an adherence resistant upper surface or low friction surface, which is able to withstand temperatures present in drip pan environments. Such adherence resistant surface greatly reduces the ability of foods, greases, fats, and the like and the charred derivatives thereof from sticking to the drip pan upper surface. Furthermore, the composite material from which the drip pan is made is such that it will not separate at temperatures present in drip pan environments. Such separation, should it occur, provides a relatively inaccessible region in the accessory for foods and charred products therefrom to collect thereby presenting a health hazard. This invention has the advantage in that separation of the composite material as produced herein for forming the drip pan is not permitted to occur thereby assisting the user in maintaining a clean and hygienic stove. Such cleanliness is particularly important in restaurants where strict compliance with health codes is required.

One embodiment of this invention is a drip pan which comprises a composite structure having a lower layer of metallic support material, an upper layer of a thermoplastic based material having an upper surface which is adherence resistant to foods, and operative to withstand temperatures present in drip pan environments, and an adhesive bonding agent, between the lower layer and the upper layer, which is operative to bond the lower layer and the upper layer together in a sandwich like assembly and also operative to prevent separation thereof under temperatures present in drip pan environments.

In another embodiment of this invention the drip pan comprises an annular rim forming the periphery of the drip pan, an annular dish-shaped body, attached to the interior annular edge of the rim, and an opening in the center of the drip pan formed by the interior annular edge of the annular dish-shaped body. In a furthur embodiment an annular shoulder is attached to the interior annular edge of the dish-shaped body, and the opening in the center of the drip pan is formed by the interior annular edge of the annular shoulder. In this embodiment the annular shoulder is elevated slightly above the lowest part of the annular dish-shaped body thereby providing a small volume in the bottom of the drip pan operative for collecting spilled liquids and foods from pots and pans and the like.

In all embodiments the upper surface of the thermoplastic based material is such that it is adherence resistant to foods, cooked foods, greases, fats and charred derivatives thereof and therefore such materials are more easily washed therefrom.

In all embodiments the adhesive bonding agent is operative to prevent separation of, or pulling apart of, the upper thermoplastic based material from the lower layer of metallic support material. Furthermore, in general such adhesive bonding agent must be such that separation of the composite layered structured material does not occur even at temperatures present in drip pan environments over many heating and cooling temperature cycles as generally encountered in drip pan environments of stoves.

In one embodiment of this invention the drip pan composite structure from which the drip pan is constructed is formed by roughening the lower surfaces of a sheet of thermoplastic based material, roughening the upper surface of a sheet of metallic support material, inserting a sheet of an adhesive of copolymer bonding agent between the two roughened surfaces, and compressing and simultaneously heating the assembled composite sheet under conditions of pressure and temperature operative to form a completely bonded composite material which will not separate in temperatures present in drip pan environments.

In one embodiment of this invention the metallic support material is an aluminum based alloy. In one embodiment of this invention the thermoplastic based material is a polytetrafluroethylene based material. In a further embodiment of this invention the thermoplastic based material is Teflon.

In one embodiment of this invention the adhesive bonding agent is a copolymer based bonding agent. In a further embodiment of this invention the copolymer based bonding agent is a fluorinated ethylene-propylene copolymer based bonding agent.

In one embodiment of this invention the drip pan is made from the composite sheet material by cutting a predetermined pattern therefrom and pressing the predetermined pattern into the desired drip pan configuration.

DESCRIPTION OF THE PREFERRED EMBODIMENT

Figure 1:
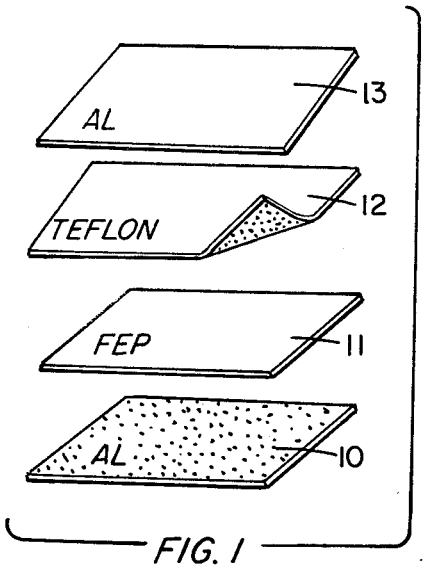
FIG. 1 is an exploded view of the material used in forming the composite sheet material from which a drip pan is formed by one embodiment of the present invention.

Referring now to FIG. 1, there is shown an exploded view of the layers of material which are used to form the composite sheet material which can be used for forming a drip pan of the instant invention. In particular, layer 10 is representative of a sheet of metallic support material. Preferably, sheet 10 is formed of a sheet of aluminum based alloy of about 0.020 inches in thickness. Layer 11 is a thin layer of a suitable adhesive bonding material such as a copolymer thermoplastic material such as a fluorinated ethylene-propylene (FEP) copolymer. Typically, the thickness of FEP layer 11 is about 0.001 inches.

Sheet 12 is a sheet of a thermoplastic based material having an upper surface which is adherence resistant to foods, cooked foods, and charred derivatives thereof such as for example a polytetrafluoroethylene based material such as Teflon. This sheet is about 0.003 inches in thickness. Finally, a thin layer 13 of a suitable slip sheet such as aluminum foil is provided. In a typical example an aluminum foil on the order of 0.001 inches in thickness is used.

In a typical example, sheet sizes for the composite sheet material are on the order of 24×44 inches or 24×51 inches. Of course, other sheet sizes can be utilized. In addition, the thickness can be varied if so desired to obtain optimum performance for specific applications. In this preferred embodiment sheet 12 is a Teflon sheet, but it is to be understood that other suitable thermoplastic based materials having the necessary characteristics above described can be used. After the sheets have been obtained, one side of aluminum sheet 10 and one side of Teflon sheet 12 are machine sanded in order to provide a roughened surface. The roughened surfaces are chemically cleaned in order to remove any residue from the sanding process. It has been found that presanding of the aluminum and Teflon sheets significantly improves the bond strength between the aluminum and Teflon sheets over the prior art methods and permits a stronger bond therebetween so that the Teflon does not peel away from the aluminum when the final product is subjected to temperatures present in drip pan environments.

Figure 2:
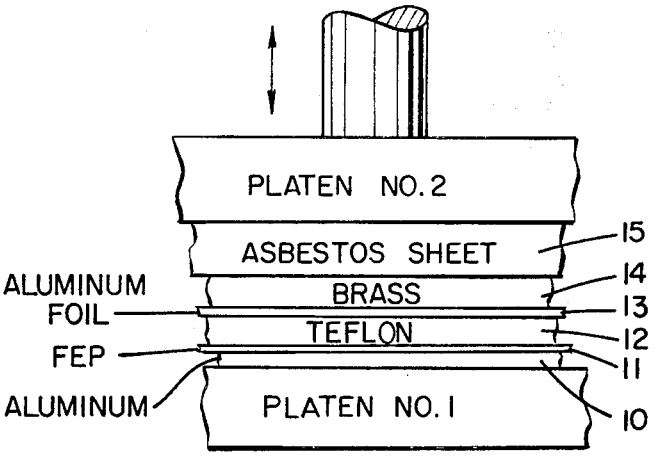
FIG. 2 shows the method in which the sheets shown in FIG. 1 are treated to form the composite sheet material for use in one embodiment of the present invention.

Referring now to FIG. 2, there is shown, schematically, the method of forming the composite sheet material. Platen no. 1 is considered to be the base or bottom platen of a suitable fabrication press. Platen no. 1 is arranged to receive heat in any suitable fashion such as by electrical heating means, gas fired heating means, or the like. The unpressed composite assembly of sheet materials shown in FIG. 1 is placed upon platen no. 1 so that aluminum sheet 10 is placed directly upon platen no. 1 with its roughened surface facing upwards. Aluminum sheet 10 is followed by FEP sheet 11 which is followed by Teflon sheet 12 with its roughened surface facing downwards in contact with FEP sheet 11. Aluminum foil sheet 13 is then placed on top of Teflon sheet 12. A thick brass sheet on the order of 0.062 inches is placed over the composite layers to form a shielding arrangement for the apparatus, as described hereinafter. An asbestos sheet 15 is then placed over brass sheet 14. The asbestos sheet can be of any suitable thickness such as for the example 0.250 inches in thickness. Platen no. 2 which may form part of a hydraulic machine along with platen no. 1, is movable relative to platen no. 1. Platen no. 2 is raised and lowered by a suitable mechanism (not shown) as indicated by the arrow.

After the sheets or layers have been assembled as noted, platen no. 2 is lowered into pressurizing contact with asbestos sheet 15. Asbestos sheet 15 serves to provide a reasonably flexible sheet or pad which permits the pressure to be evenly distributed to the other materials. Asbestos sheet 15 also prevents heat from being lost through platen no. 2 as will be described hereinafter. A pressure of approximately 150 psig is applied to the composite layers of material by a compressive force applied to the platens. When 150 psig is reached, platen no. 1 is heated to approximately 750° F. thereby effectively causing FEP layer 11 to flow into the roughened surfaces of aluminum sheet 10 and Teflon sheet 12 thereby bonding Teflon layer 12 to aluminum layer 10. The heat and pressure noted above are maintained for approximately ½ hour. Thereafter, the temperature is allowed to cool to about 400° F. and the system is maintained in a heated and pressurized condition for approximately ½ hour. Thereafter, heating and pressurization of the press are stopped. Asbestos sheet 15 and brass protective layer 14 are removed. A composite structure comprising layers 10, 11, 12, and 13 is now removed from the press and ready for the next operation.

Figure 3:
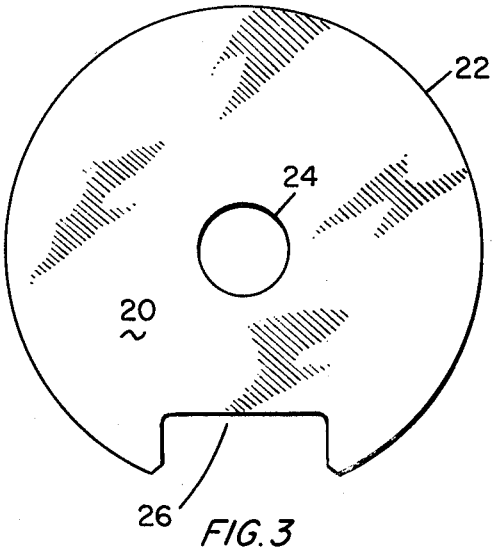
FIG. 3 shows a predetermined pattern cut from the composite sheet material which can be used to form a drip pan.

Referring now to FIG. 3, there is shown a predetermined pattern of appropriate shape. This predetermined pattern is cut by steel rule dyes which are used to cut the composite sheet material formed in the apparatus and method shown in FIG. 2. The predetermined pattern, as shown in FIG. 3, comprises an annular disk 20 having outer periphery 22, inner periphery 24, and notch 26.

Figure 4:
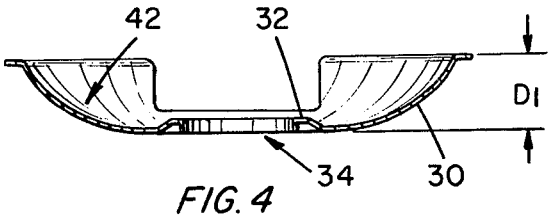
FIG. 4 is a cross-sectional view of a drip pan designed for use under a relatively small heating unit of a stove.
Figure 5:
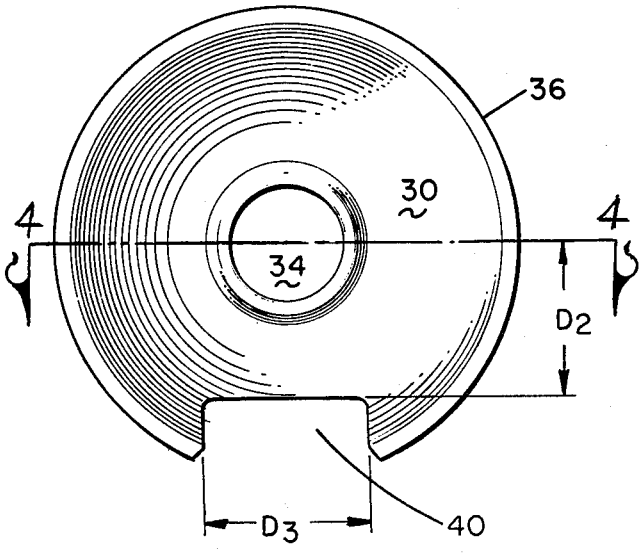
FIG. 5 is a plain view of the drip pan shown in FIG. 4.
Figure 6:
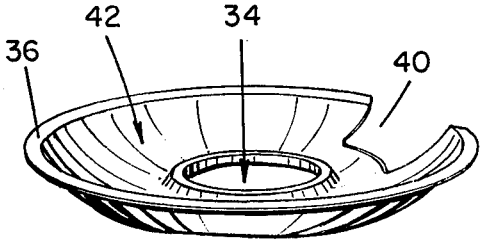
FIG. 6 is a perspective view of the drip pan shown in FIGS. 4 and 5.

Annular disk 20 is subjected to a pressing operation in a press contoured to produce a drip pan as shown in FIGS. 4, 5, and 6. In practice it may be desirable to subject the blank to several forming or pressing operations before the final product is produced as shown in FIG. 6. Machine sanding or the like to remove any undesirable burrs can be performed either before or between pressing steps or after the final pressing step.

Aluminum foil sheet 13 is usually removed before the final pressing operation. However if desired sheet 13 can be removed after the final pressing operation.

Referring now to FIG. 4, there is shown a cross-sectional view of one particular embodiment of the drip pan suitable for use under a small heating unit of a stove. FIG. 5 shows a plain view of the same drip pan shown in FIG. 4. Shoulder 32 is elevated about 0.14 inches above the lowest point of drip pan 30. Opening 34 is about 2 inches in diameter. Annular rim 36 is about ¼ inch in width. The outer periphery of annular rim 36 is about 8.1 inches. The overall depth, dimension $D_1$, FIG. 4, is about 1¼ inches. Rectangular notch 40 is about 2.6 inches from the center of the drip pan, dimension $D_2$, and has a width of about 2.9 inches, dimension $D_3$. Suitable chamfers and fillets can be added to notch 40 as shown in FIG. 5. FIG. 6 shows a perspective view of the drip pan shown in FIGS. 4 and 5.

Thus, there has been shown and described an improved accessory or drip pan for a stove and an improved method of making same including the method of making the material from which drip pans can be produced. The improved method permits the composite sheet material from which the drip pan is made to be bonded together in an improved manner which prevents separation thereof even at temperatures present in drip pan environments. Temperatures in drip pan environments typically are as high as about 260° F. or higher. In a further embodiment of this invention the thermoplastic based material is heat resistant at temperatures up to about 550° F. with continuous exposure to such temperatures. The upper surface 42 of drip pan 30 of FIG. 4 is such that it is adherence resistant to foods, cooked foods, greases, fats, and the like, and charred derivatives thereof. In other words, upper surface 42 is a low friction surface.

The description includes specific material used for forming a particular embodiment of the composite structure material as well as specific dimensional representations of the final product. However, it should be understood that these materials and dimensional representations can be altered or modified by those skilled in the art to achieve preferred characteristics for certain applications of the invention. Such modifications will fall within the purview of the instant description and are intended to be embodiments of this invention as well as the preferred embodiment herein illustrated. The description noted above is intended to be illustrative only and the invention is not intended to be limited thereby. Rather, the scope of the invention is limited only by the claims appending hereto.

What is claimed is:

1. A drip pan for use under a heating unit of a stove comprising:

an annular dish-shaped composite structure having
- a lower layer of a metallic support material,
- an upper layer of a thermoplastic based material, having an upper surface which is adherence resistant to foods and charred derivatives thereof, and operative to withstand temperatures present in drip pan environments, and
- an adhesive bonding agent, between said lower layer and said upper layer, operative to bond said lower layer and said upper layer together in sandwich like assembly, and operative to prevent separation thereof at temperatures present in drip pan environments, an annular rim forming the periphery of said composite structure, an annular dish-shaped body attached to the interior annular edge of said annular rim and forming the interior of said composite structure, and an opening in the center of said composite structure formed by the interior annular edge of said annular dish-shaped body.

2. A drip pan for use under a heating unit of a stove comprising:

an annular dish-shaped composite structure having
- a lower layer of an aluminum-based alloy support material,
- an upper layer of a polytetrafluoroethylene based thermoplastic material, having an upper surface which is adherence resistant to foods, cooked foods, and charred derivatives thereof, and operative to withstand temperatures present in drip pan environments, and
- an adhesive copolymer based bonding layer, between said lower layer and said upper layer, operative to bond said lower layer and said upper layer together in sandwich like assembly and operative to prevent separation thereof at temperatures present in drip pan environments, an annular rim forming the periphery of said composite structure, an annular dish-shaped body attached to the interior annular edge of said annular rim and forming the interior of said composite structure, an annular shoulder attached to the interior annular edge of said dish-shaped body and for preventing, when in use, spilled foods from spilling out of said annular dish-shaped body, and an opening in the center of said composite structure formed by the interior annular edge of said annular shoulder.

3. A drip pan, made from a composite sheet material, for use under a heating unit of a stove comprising:

an annular rim forming the periphery of said drip pan, an annular dish-shaped body attached to the interior annular edge of said annular rim and forming the interior of said drip pan, an annular shoulder attached to the interior annular edge of said dish-shaped body, for preventing, when in use, spilled foods from spilling out of said annular dish-shaped body, and an opening in the center of said drip pan formed by the interior annular edge of said annular shoulder, said composite sheet material being formed by the process comprising:
- roughening the lower surface of a layer of thermoplastic based material having an upper surface which is adherence resistant to foods, cooked foods, and charred derivatives thereof, and which is operative to withstand temperatures in drip pan environments,
- roughening the upper surface of a layer of a metallic support material,
- inserting a layer of an adhesive copolymer bonding material between said roughening lower surface of said thermoplastic based material and said roughened upper surface of said metallic support material, thereby forming a ready-to-press composite sheet,
- compressing and simultaneously heating said ready-to-press composite sheet under conditions of pressure and temperature operative to form said composite sheet material the layers of which are bonded together so that said layers will not separate at temperatures present in drip pan environments.

4. The apparatus of claim 1 wherein said annular dish-shaped composite structure is formed by the process comprising:

a. roughening the lower surface of a layer of thermoplastic based material having an upper surface which is adherence resistant to foods, cooked foods, and charred derivatives thereof, and which is operative to withstand the temperatures in drip pan environments;

b. roughening the upper surface of a layer of a metallic support material;

c. inserting a layer of an adhesive copolymer bonding agent between said roughened lower surface of said thermoplastic based material and said roughened upper surface of said metallic support material, thereby forming a ready-to-press composite sheet;

d. compressing and simultaneously heating said ready-to-press composite sheet under conditions of pressure and temperature operative to form a composite structure, the layers of which are bonded together so that said layers will not separate at temperatures present in drip pan environments;

e. cutting a predetermined pattern from said composite structure; and f. forming from said predetermined pattern said drip pan.

5. The apparatus of claim 2 wherein said annular dish-shaped composite structure is formed by the process comprising:

a. roughening the lower surface of a layer of polytetrafluoroethylene based thermoplastic material having an upper surface which is adherence resistant to foods, cooked foods, and charred derivatives thereof, and which is operative to withstand temperatures in drip pan environments;

b. roughening the upper surface of a layer of an aluminum-based alloy support material;

c. inserting a sheet of an adhesive copolymer based bonding layer between said roughened lower surface of said polytetrafluoroethylene based thermoplastic material and said roughened upper surface of said aluminum-based alloy support material, thereby forming a ready-to-press composite sheet;

d. compressing and simultaneously heating said ready-to-press composite sheet under conditions of pressure and temperature operative to form a composite structure, the layers of which are bonded together so that said layers will not separate at temperatures present in drip pan environments;

e. cutting a predetermined pattern from said composite structure; and f. forming from said predetermined pattern said drip pan.

6. The apparatus of claim 3 wherein said metallic support material is an aluminum-based alloy.

7. The apparatus of claim 1 wherein said thermoplastic based material is a polytetrafluoroethylene based material.

8. The apparatus of claim 3 wherein said thermoplastic based material is a polytetrafluoroethylene based material.

9. The apparatus of claim 2 wherein said polytetrafluoroethylene based thermoplastic material is Teflon.

10. The apparatus of claim 3 wherein said thermoplastic based material is Teflon.

11. The apparatus of claim 1 wherein said adhesive bonding agent is a copolymer based bonding agent.

12. The apparatus of claim 2 wherein said adhesive copolymer based bonding agent is a fluorinated ethylene-propylene copolymer based bonding agent.

13. The apparatus of claim 3 wherein said adhesive copolymer bonding material is a fluorinated ethylene-propylene copolymer based bonding material.

14. The apparatus of claim 3 wherein said annular rim has a width of about 0.25 inches, the overall depth of said drip pan is about 1.5 inches, said opening is about 2 inches in diameter, and the height of said annular shoulder is about 0.14 inches.

15. The apparatus of claim 3 wherein said drip pan is made from said composite sheet material by cutting a predetermined pattern therefrom and pressing said predetermined pattern into the configuration of said drip pan.

16. The apparatus of claim 1 wherein said drip pan has a wall thickness from about 0.02 to about 0.03 inches.

17. The apparatus of claim 2 wherein said drip pan has a wall thickness from about 0.02 to about 0.03 inches.

18. The apparatus of claim 3 wherein said composite sheet material has a wall thickness from about 0.02 to about 0.03 inches.

19. The apparatus of claim 2 further comprising a notch formed by an opening in a small part of said annular rim and an opening in a small part of said annular dish-shaped body which is adjacent to said opening in said annular rim.

20. The apparatus of claim 3 further comprising a notch formed by an opening in a small part of said annular rim and an opening in a small part of said annular dish-shaped body which is adjacent to said opening in said annular rim.

21. The apparatus of claim 1 wherein said composite structure of said drip pan is operative to withstand continuous exposures to temperatures at least as high as 260° F.

22. The apparatus of claim 1 wherein said composite structure of said drip pan is operative to withstand continuous exposures to temperatures at least as high as 500° F.

23. The apparatus of claim 2 wherein the elevation of said annular shoulder, when viewed in cross-section, is lowest on the exterior and interior periphery thereof, and is highest at a point about midway between the exterior and interior periphery thereof, and wherein the configuration of said annular shoulder reduces the flexibility of, and improves the stiffness of, said drip pan.

* * * * *